United States Patent [19]

Moll

[11] Patent Number: 4,619,198

[45] Date of Patent: Oct. 28, 1986

[54] METHOD AND APPARATUS FOR KEYLESS OFFSET PRINTING

[76] Inventor: Joseph P. Moll, 1310 Elm Dr., Schaumburg, Ill. 60194

[21] Appl. No.: 686,040

[22] Filed: Dec. 24, 1984

[51] Int. Cl.[4] ..... B41F 7/26; B41F 7/28; B41F 7/36; B41L 25/02

[52] U.S. Cl. ..... 101/148; 101/350

[58] Field of Search ..... 101/148, 147, 350, 363, 101/349, 207–210, 366

[56] References Cited

U.S. PATENT DOCUMENTS

| | | | |
|---|---|---|---|
| 3,545,379 | 12/1970 | Norton | 101/148 |
| 4,040,348 | 8/1977 | Gertsch et al. | 101/148 |
| 4,157,682 | 6/1979 | Mabraik et al. | 101/148 |
| 4,287,827 | 9/1981 | Warner | 101/148 |
| 4,461,208 | 7/1984 | Ghisalberti | 101/148 |
| 4,527,479 | 7/1985 | Dahlgren et al. | 101/148 |

*Primary Examiner*—J. Reed Fisher

[57] ABSTRACT

A keyless printing method and apparatus that employs an engraved drum with discrete proportioning ink and water attracting areas to transfer ink and water to a plate cylinder without metering blades at the drum.

13 Claims, 6 Drawing Figures

METHOD AND APPARATUS FOR KEYLESS OFFSET PRINTING

BACKGROUND OF THE INVENTION

Offset printing techniques have found considerable success in the newspaper printing industry principally as a result of the simple plate making and changing required, relatively low cost and consistency of printing quality.

The lithographic plate on the plate cylinder in these systems is frequently an engraved drum formed by photographically produced areas that attract oil-based ink and other areas that attract water.

These lithographic offset presses employ clusters of rollers for transfering ink and water, usually in separate clusters, from ink and water supply fountains to the plate cylinder. The last rollers in the cluster are usually rubber or another elastomer that directly engage the plate cylinder and are referred to as form rollers.

In order to evenly distribute ink and water on the plate cylinder it has been found necessary that the number of rollers in each cluster, or train, be quite high and thus significantly contribute to the cost as well as the maintenance of the press.

In the newspaper printing art, where paginated sheets are arranged in columnar fashion, usually nine, the ink demand in each column varies depending upon the amount and arrangement of text, and even more particularly because of the quantity of pictorial images in any column.

This variation in columnar demand at the plate cylinder has in the past been satisfied with separately controllable ink-injecting or metering systems for each column, commonly referred to as "keys". After each new plate change, and frequently more often, the pressman must adjust each of these keys individually to satisfy the ink demand in each column. This is not only a time-consuming task for the pressman that increases printing costs, but frequently more importantly delays newspaper publication. Furthermore, these ink-injecting and metering systems are extremely complex mechanically with a single nine-column injector system frequently having literally hundreds of parts.

There have in the very recent past been attempts to eliminate the need for individual columnar ink-injection and metering systems in the offset printing of paginated newspapers, and while some have achieved a degree of success, they have done so with significant trade-offs. One of these so-called "keyless" systems has been referred to as the "anilox" system and includes the provision of an ink supply roller in the ink train that essentially is a metallic drum with shallow uniform recesses in its exterior surface. This ink-supply drum is coated totally and evenly with ink from the ink fountain and after coating a doctor blade directly engaging the exterior surface of the drum, scrapes all of the ink from the drum save the ink in the shallow recesses. In effect, the "anilox" supply drum acts as a metering drum and while it accomplishes this objective in an accurate fashion, it does have several significant disadvantages. Firstly, the quantity of ink transferred by this supply drum is fixed by the depth, size and number of shallow recesses on the drum surface. Therefore, if the demand of the plate cylinder for ink exceeds the capability of the metering drum, a new metering drum needs to be provided. Another disadvantage is because the doctor blade has direct contact with the metering surface, it experiences considerable wear and needs to be replaced very frequently to avoid streaking on the plate cylinder which results in a streaking image on the newsprint itself.

Furthermore, because the "anilox" metering drum has the capability of tranferring only ink and not water, it must be positioned in the ink train and thus increases the length—and therefore the cost—of the ink train.

There have also in the past been attempts to reduce the length of the ink and water trains through the provision of a combined ink and water proportioning drum. It should be noted at the outset in this discussion, however, that such attempts have been totally apart from the above-described work in attempting to eliminate the requirement for columnar ink injection systems. One such ink train length reduction attampt is illustrated in the Warner U.S. Pat. No. 4,287,827 and includes the provision of a lithographic cylinder in the ink and water supply trains upstream from the plate cylinder. Warner provides a combined water and ink transfer drum that has a plurality of "ink loving" and "water loving" areas on its surface defined by a chromium drum with etched copper areas on its surface. Warner attempted to reduce the length of the ink and water supply trains employing this combined water and ink proportioning drum, but experience at least thus far indicates that the use of this proportioning drum does not significantly, if at all, reduce the required length of the ink and water supply trains.

It is the primary object of the present invention to ameliorate the problems noted above in offset printing systems for the newspaper industry that have heretofore required a plurality of individual columnar metering systems.

SUMMARY OF THE PRESENT INVENTION

In accordance with the present invention, an offset printing method and apparatus are provided for paginated columnar newsprint that eliminate the numerous individual columnar ink-metering systems and controls by employing a water and ink proportioning drum in a combined ink and water supply train and operating the system so that sufficient ink is supplied from the ink fountain to the ink-water proportioning drum, entirely across the drum, to satisfy the demand for ink at the plate cylinder for the column requiring the most ink. This, of course, by definition means that all other areas of the ink-water proportioning drum carry more ink than required for the corresponding plate cylinder column. An important aspect of the present invention is that the undemanded ink, i.e. the ink not demanded by the plates from the ink-water proportioning drum, is scraped from the proportioning drum.

This simple method and its attendant apparatus have dramatically simplified the offset printing of columnar newsprint. The most significant initial cost advantage is the elimination of the extremely mechanically complex and numerous individual columnar ink-metering devices or injectors, along with the ancillary controls which are frequently computerized. When not computerized, and even to some extent when computerized, the individual columnar adjustment of these columnar metering devices or "keys" as they are sometimes called, is a very time-consuming process.

Another advantage in the present offset printing method is that the use of the ink-water proportioning drum decreases the length of ink and water supply trains over present totally separate ink and water supply trains.

The removal of substantially all ink from the ink-water proportioning drum prior to 360 degree revolution of that drum has several advantages. Firstly, it permits the system to maintain a constant ink and water flow to the ink and water proportioning drum for a given press speed. This is an important aspect of the present invention because the ink and water fountains are during setup adjusted so that the ink supply entirely across the ink-water proportioning drum is sufficient to satisfy the highest demand column on the plate cylinder. If any significant quantity of ink is recirculated, this relationship would be disturbed.

An additional advantage in scraping substantially all of the ink and water from the ink-water proportioning drum is the elimination of recirculating foreign particles, such as lint, in the system.

Another important aspect of the present invention is that the ink-water proportioning drum has the capability of supplying varying quantities of ink to the plate cylinder. One proportioning drum that has been found satisfactory for this purpose is a copper plated drum with photographically etched and uniformly distributed chromium areas. The copper areas are oleophilic, or oil-based ink-attracting and the chromium areas are hydrophilic, or water-attracting areas. Since the ratio of the copper areas to the chromium areas on the drum are fixed, the ratio between ink and water on the drum remains fixed, but however and importantly, the thickness of the ink-water film on the drum itself may vary significantly.

The thickness of the ink-water film on the drum is determined on initial plate change by varying the speed and metering at the ink and water fountains. There is no blade metering at the proportioning drum at all, in contrast to recently developed anilox keyless printing systems. The initial adjustment at the ink and water fountains need not be precise so long as the ink flow to the proportioning drum is sufficient to satisfy the demand of the highest demand column.

Another aspect of the present invention is the provision of a control system for the ink and water fountains that facilitates the initial setup as well as the normal operation of the press. Toward this end the ink fountain includes a plurality of metering blades and only a single blade is provided for each page. Each of these blades is adapted to be positioned either in one of two positions, one engaging an ink fountain roller to block an entire page when no printing is desired and the other spaced from the fountain roller in which it meters flow. Normally the pressman would not make any fine adjustments in these metering blades to achieve the initial excess ink flow requirement. Ink flow variation is usually controlled by varying the speed of the ink fountain roller by changing the speed of an ink fountain drive motor. This motor can be controlled by a manual speed control system and during normal operation of the press is computer-controlled by a press speed responsive proportional control system.

The water fountain includes a rotating brush and bristle flicking system and the water flow is controlled by a separate brush motor speed control system in a fashion similar to the control of the ink fountain motor.

DETAILED DESCRIPTION OF THE PREFERRED EMBODIMENT

Figure 1:
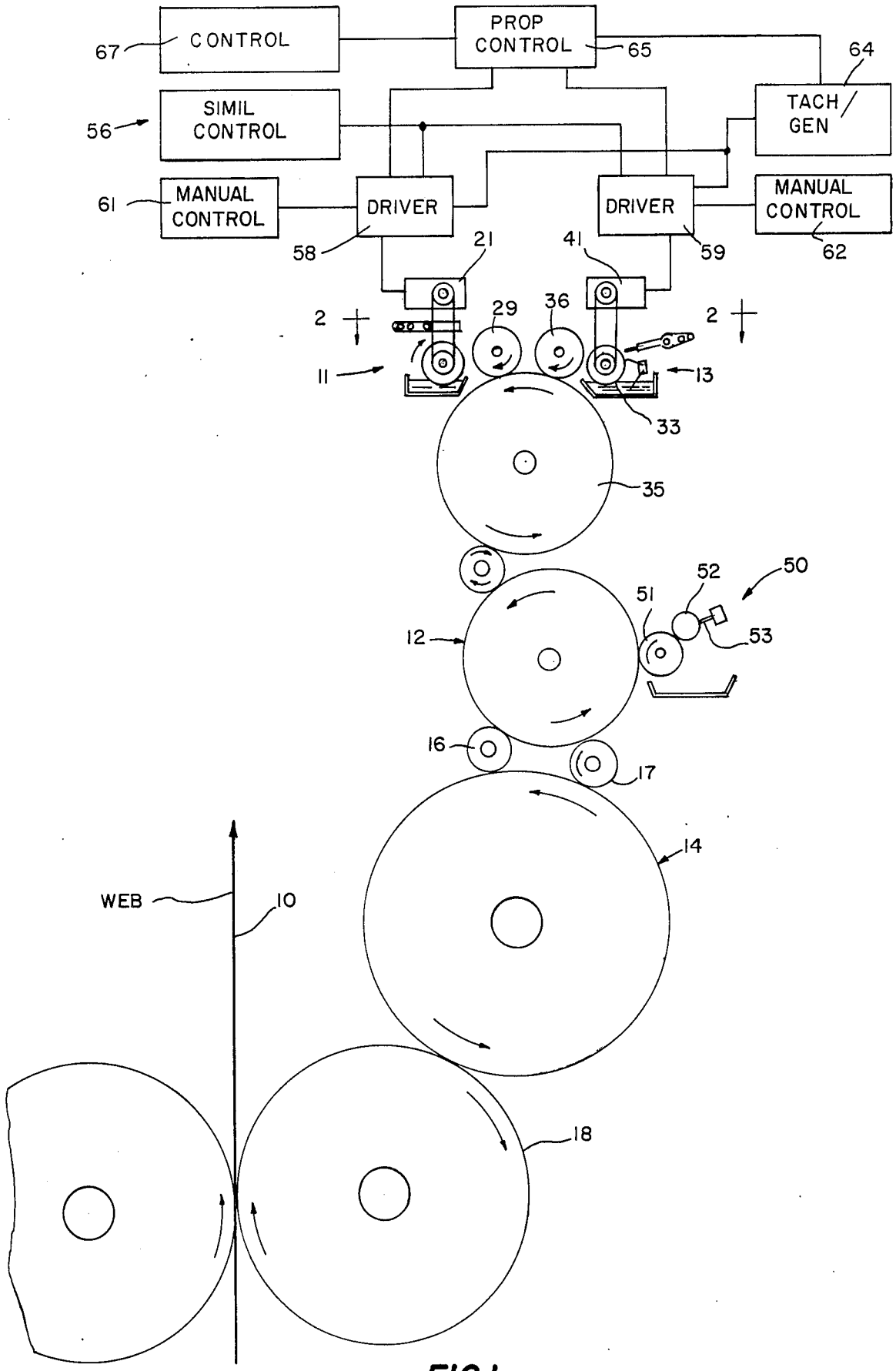
FIG. 1 is a perspective view of the present offset printing system with ink and water fountain controls.

Referring to the drawings and particularly to FIG. 1 where a schematic diagram of the present offset printing system is illustrated, the present offset system is seen to be of the type employing a vertically traversing web or sheet 10 and therefore may be referred to as a vertical press, although it should be understood that the principles of operation of the present invention may be applied to horizontally traversing web machines as well. The principles of the present invention are particularly adapted to the newspaper industry and more specifically to the printing of multiple-columnar paginated sheets incorporating both typed copy and images where each column has a different demand for ink.

Viewing FIG. 1, the present offset system is seen to generally include a water fountain 11 and an ink fountain 13 that supply ink and water to an ink and water proportioning drum 12 which in turn delivers ink and water to the plates through form rollers 16 and 17. Offset plate cylinder 14 utilizes a conventional blanket cylinder 18 for transferring the image to the web 10.

Figure 2:
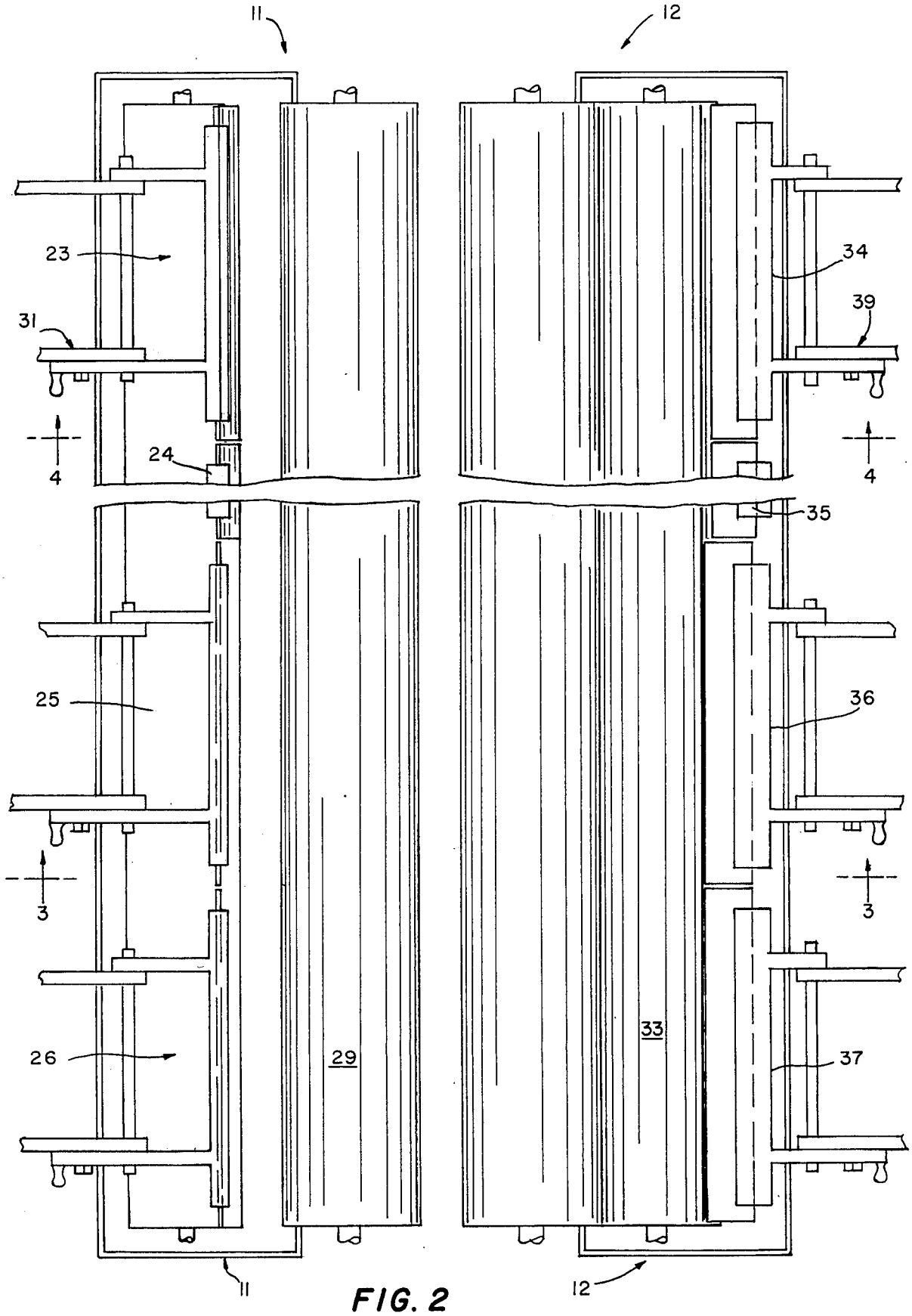
FIG. 2 is an enlarged top view of the ink and water fountains taken generally along line 2—2 of FIG. 1.
Figure 3:
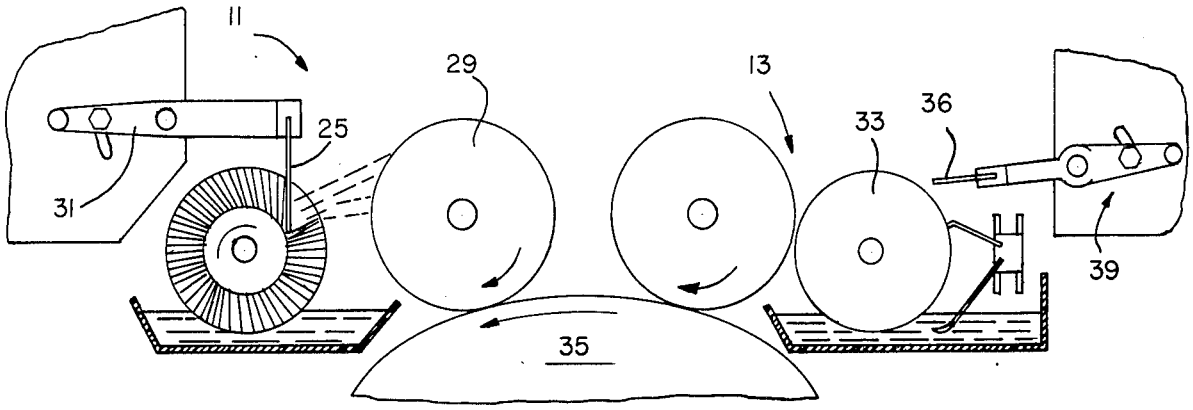
FIG. 3 is an end view of the ink and water fountains with both fountains activated for a single page, taken generally along line 3—3 of FIG. 2.
Figure 4:
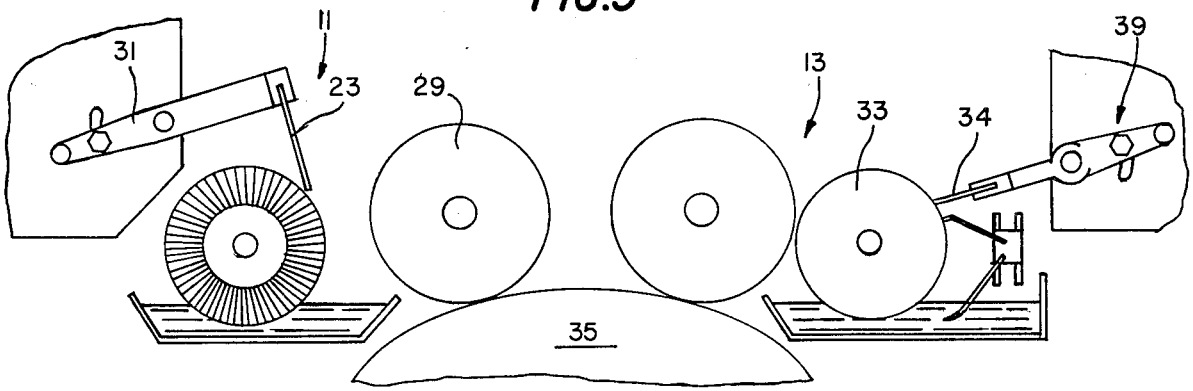
FIG. 4 is an end view of the ink and water fountains illustrating both in their inactive positions for a single page taken generally long line 4—4 of FIG. 2.

As seen more clearly in FIGS. 2, 3 and 4, the water fountain 12 includes a rotating fountain brush 20 driven by a variable speed water fountain motor 21 (see FIG. 1) and four selectively operable flicker blades 23, 24, 25 and 26 engageable with bristles 27 on the brush 20 as seen in FIGS. 1 and 3 to flick water entrained in the bristles onto transfer roller 29 into the ink train.

Each of the blades 23, 24, 25 and 26 extends across an entire newsprint page, so that the press as illustrated is capable of accommodating four laterally spaced pages, or more succinctly, a four-page pagination. The blades 23, 24, 25 and 26 each have individual adjusting mechanisms 31 for moving the blades from the active position illustrated in FIG. 3 to the inactive position in FIG. 4. This brush water-flicking technique has been found to be very satisfactory in providing an even distribution of water on the transfer roller 29.

The blades 23, 24, 25 and 26 are usually either in their active position as illustrated in FIG. 3 or their inactive position illustrated in FIG. 4 and variation in the amount of water flow to the transfer roller 29 is controlled mainly by varying the speed of the motor 21 with the control circuitry illustrated schematically in FIG. 1.

The water fountain can alternatively be applied to transfer roller 38.

The ink fountain 13 is seen to include an ink fountain roller 33 immersed in an oil-based ink and selectively operable metering blades 34, 35, 36 and 37 illustrated in FIG. 2. Similar to the water-flicking blades, one of the blades 34, 35, 36 and 37 is provided for each page, not each column, of the web. The metering blades 34, 35, 36 and 37 are positionable by adjusting mechanisms 39, either in contact with ink fountain roller 33, which is its inactive position, or to a position spaced from roller 33 in its metering position.

A horizontally reciprocating agitator 38 is provided in the ink fountain that has an upper blade 38*a* closely spaced from fountain roller 33 and a lower blade 38*b* reciprocating in the ink bath to maintain a constant supply of ink on the ink fountain roller.

Since the blades 34, 35, 36 and 37 are either in their inactive position or their active position illustrated in FIG. 3, ink flow variation from the ink fountain roller 33 is usually achieved by varying the speed of variable speed drive motor 41 for the ink fountain roller 33. Ink from the ink fountain roller 33 is delivered to a transfer drum 35 by an ink fountain transfer roller 36 and water is transferred to drum 35 by transfer roller 29.

The ink and water proportioning drum 12 receives ink and water from ink and water transfer drum 35 by an ink-water transfer roller.

Figure 5:
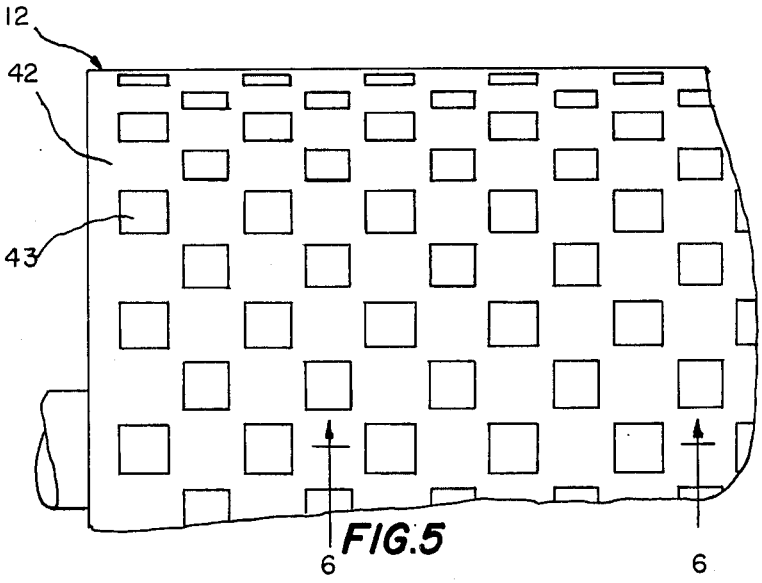
FIG. 5 is a fragmentary front view of the ink and water proportioning drum.

The ink and water proportioning drum 12 is a vibrating engraved drum preferably formed by the photographic etching of a chromium layer on a copper base. As seen in FIG. 5, the copper base layer 42 has a chromium layer deposited thereon that is photographically and chemically etched to provide a plurality of rectangular chromium areas uniformly distributed across the surface of the drum. The ratio of the areas of the chromium rectangles 43 to the utilized exposed copper areas is selected to generally equal the normal ink and water ratio required on the average plate, and as those experienced in the printing industry will appreciate this ratio is flexible so that a given ratio on drum 12 can be used for a wide variety of plates on plate cylinder 14.

Figure 6:
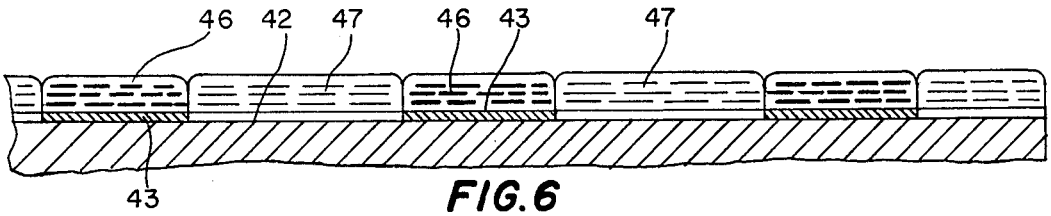
FIG. 6 is a fragmentary section of the ink and water proportioning drum taken generally along line 6—6 of FIG. 5.

The copper areas 43 are oleophilic and therefore ink-attracting and the useful chromium areas 42 are hydrophilic and therefore water attracting and each hold individual quantities of ink 46 and water 47 as illustrated in FIG. 6. This results in the drum 12 carrying a substantially fixed proportion of ink to water, but it is important to note that the volume of ink carried by the drum can be easily varied by varying the thickness of the ink areas 46 on the drum, and this is done by varying the ink and water fountains 11 and 13 as opposed to any metering at the drum 12 itself, which is an important aspect of the present invention.

After transfer of the demanded ink and water from the proportioning drum 12 to the plate cylinder 14 by the form rollers 16 and 17, substantially all the remaining ink and water is scraped from the drum by scraper assembly 50. The scraper assembly 50 includes a rubber scraper roller 51 contacting proportioning drum 12 and a steel scraper roller 52. Steel scraper roller 52 is engaged by a scraper blade 53, preferably constructed of a plastic material such as nylon, to prevent scratching roller 52.

As seen in FIG. 1, control system 56 is provided for the motors 21 and 41 and serves to control the ink and water delivery to the proportioning drum 12. Toward this end control circuitry 56 is solid state and includes motor drivers 58 and 59 that modulate conventional pulse width modulation circuitry that vary the duty cycle of driving pulse trains to motors 21 and 41 to effect speed control variation. Each of the drivers 58 and 59 may be controlled manually by manual control circuits 61 and 62 that are utilized during system setup to adjust not only the relative proportion of ink and water, but also the volume of ink and water to the proportioning drum 12 by varying the speed of brush 27 and ink fountain roller 33.

The water fountain brush 27 and the ink fountain roller 33 are also driven in proportional to press speed. Toward that end a tachometer 64 is provided driven by one of the main press rollers that provides signals to a proportional control 65 representing press speed and provides signals to drivers 58 and 59 to modulate the respective motor drive pulse trains in accordance with press speed. Thus the drivers 58 and 59 are not only biased by manual controls 61 and 62 but modulated by press speed proportional control 65. Proportional control 65 is also adjustable by control 67 which varies the sensitivity of driver control signals to press speed as desired.

After plate changes at plate cylinder 14, the pressman varies manual control 61 and 62 with the press running until enough ink is delivered to the proportioning cylinder 12 and the plate cylinder 14 sufficient to satisfy or exceed somewhat the ink demand in the column on plate 14 and web 10 requiring the most amount of ink. This, of course, is determined by observing the images on the highest demand column on web 10. No individual column adjustments need be made and in fact, there are none in the present system. This particular adjustment does not have to be precise but the adjustments must be such that ink delivery is sufficient or slightly in excess of that required for the highest demand column on web 10, which may, for example, have four transversely disposed pagesand 36 columns. This adjustment is not critical in the present method and system.

An important aspect of the present invention is that the scraper assembly 50 removed substantially all of the remaining ink and water on the proportioning drum 12 prior to the transfer roller 36. This maintains the integrity and accuracy of ink delivered to the proportioning roller 12 because it eliminates recirculation of ink, or substantially so. It has the further advantage of eliminating the recirculation of foreign material such as lint in the system, which has been a problem in the newsprint industry. Moreover, the ink fountain roller 33 and transfer roller 36 are spaced at 0.007 inches to prevent circulation of lint and other foreign material back to the ink fountain.

I claim:

1. A method of offset printing paginated sheets having differential columnar ink demand without individual columnar ink controlling systems, employing an ink fountain and a water fountain for supplying ink and water to a variable ink-water drum having a plurality of discrete hydrophilic and oleophilic areas, each capable of holding varying quantities of water and ink for transferring variable quantities of ink and water from the ink and water fountains to a plate cylinder and a scraper system for removing ink from the variable ink-water drum, wherein the plate cylinder carries a columnar plate with varying columnar ink demand, and a form roller for transferring ink and water from the ink-water drum to the plate cylinder including the steps of: adjusting the ink and water fountains to supply ink to the variable ink-water drum in sufficient and uniform amounts entirely across the drum to meet the demand for the plate cylinder column and corresponding sheet column requiring the highest quantity of ink of all columns and to exceed the demand of the other plate cylinder columns and corresponding sheet columns, and without metering ink and water directly on the ink-water drum, transferring ink and water from the variable ink-water drum with the form roller to the plate cylinder.

2. A method of offset printing paginated sheets having differential columnar ink demand without individual columnar ink controlling systems as defined in claim 1, including the step of scraping substantially all of the ink and water from the ink-water drum after transfer of the demanded ink and water to the plate cylinder.

3. A method of offset printing paginated sheets having differential columnar ink demand without individual columnar ink controlling systems as defined in claim 2, including the step of transfering the ink and water from the ink-water drum to the plate cylinder with a pair of form rollers.

4. A method of offset printing paginated sheets having differential columnar ink demand without individual columnar ink controlling systems as defined in claim 1, wherein the ink and water fountains each have separate drive motors, including the step of manually controlling the ink and water drive motors to achieve the excess ink requirement, and simultaneously controlling the ink and water fountain motors in proportion to press speed during normal operation.

5. A method of offset printing paginated sheets having differential columnar ink demand without individual columnar ink controlling systems, employing an ink fountain and a water fountain for supplying ink and water to a variable ink-water drum having a plurality of discrete hydrophilic and oleophilic areas each capable of holding varying quantities of water and ink for transferring variable quantities of ink and water from the ink and water fountains to a plate cylinder and a scraper system for removing ink from the variable ink-water drum wherein the plate cylinder carries a columnar plate with varying columnar ink demand, and a form roller for transferring ink and water from the ink-water drum to the plate cylinder, including the steps of: adjusting the ink and water fountains to supply ink to the variable ink-water drum in sufficient and uniform amounts entirely acros the drum to meet the demand for the plate cylinder column and the corresponding sheet column requiring the highest quantity of ink of all columns and to exceed the demand of the other plate clyinder columns and corresponding sheet columns, without blade metering ink and water from the ink-water drum to the plate cylinder, and including the step of scraping substantially all of the ink and water from the ink-water drum after transfer of the demanded ink and water to the plate cylinder.

6. A method of offset printing paginated sheets having differential columnar ink demand without individual columnar ink controlling systems, employing an ink fountain and a water fountain for supplying ink and water to a variable ink-water drum having a plurality of discrete hydrophilic and oleophilic areas each capable of holding varying quantities of water and ink for transferring varying quantities of ink and water from the ink and water fountains to a plate cylinder, and a scraper system for removing ink from the variable ink-water drum, wherein the plate cylinder carries a columnar plate with varying columnar ink demand, and a form roller for transferring ink and water from the ink-water drum to the plate cylinder, including the steps of: adjusting the ink and water fountains to supply ink and water in sufficient and uniform quantities entirely across the ink-water drum to satisfy the demand of the most ink demanding column on the plate cylinder, transferring ink and water from the ink-water drum to the plate cylinder with the form roller, and removing substantially all of the ink and water from the ink-water drum after transfer of the demanded ink from the ink-water drum to the plate cylinder.

7. A method of offset printing paginated sheets having differential columnar ink demand without individual columnar ink controlling systems as defined in claim 6, wherein the ink and water fountains each have separate drive motors, including the step of manually controlling the ink and water drive motors to achieve the excess ink requirement, and simultaneously controlling the ink and water fountain motors in proportion to press speed during normal operation.

8. An offset printing system for printing paginated sheets having differential columnar ink demand without the use of any individual columnar ink control systems, comprising: ink fountain means, water fountain means, a plate cylinder carrying a columnar plate with varying columnar ink demand, a variable ink-water supply drum that is capable of receiving varying quantities of ink and water from the ink and water fountain means and transfers them to the plate cylinder, said variable ink-water supply drum including a plurality of discrete hydrophilic and oleophilic areas capable of receiving and holding variable quantities in film thickness of ink and water, form roller means for transferring ink and water from the ink-water supply drum to the plate cylinder without any metering of the ink-water supply drum, and means for removing substantially all of the remaining ink and water from the ink-water supply drum.

9. An offset printing system for printing paginated sheets having differential columnar ink demand without the use of any individual columnar ink control systems as defined in claim 8, wherein the means for removing the ink and water from the ink-water supply drum includes a rubber transfer roller in contact with the ink-water supply drum, a metal roller in engagement with the rubber transfer roller, and a scraper blade in engagement with the metal roller.

10. An offset printing system for printing paginated sheets having differential columnar ink demand without the use of any individual columnar ink control systems as defined in claim 8, wherein the ink-water supply drum is an engraved drum with the hydrophilic areas defined by chromium and the oleophilic areas being defined by copper.

11. An offset printing system for printing paginated sheets having differential columnar ink demand without the use of any individual columnar ink control systems as defined in claim 9, wherein the water fountain includes a rotating bristled brush, a transfer roller spaced from but adjacent said brush, and means for flicking the brush as it rotates to throw water from the brush to the transfer roller into the ink train.

12. An offset printing system for printing paginated sheets having differential columnar ink demand without the use of any individual columnar ink control systems as defined in claim 8, including a motor for driving the ink fountain means, a separate motor for driving the water fountain means, a control circuit for controlling the operation of the motors including manual control means for individually controlling the speed of the ink and water fountain motors, and means for simultaneously controlling the motors in proportion to the speed of the press.

13. An offset printing system for printing paginated sheets having differential columnar ink demand without the use of any individual columnar ink control systems, comprising: ink fountain means, water fountain means, a plate cylinder carrying a columnar plate with varying columnar ink demand, a variable ink-water supply drum that receives ink and water from the ink and water fountain means and transfers them to the plate cylinder, said variable ink-water supply drum including a plurality of discrete hydrophilic and olelphilic areas capable of receiving and holding variable quantities in film thickness of ink and water, form roller means for transferring ink and water from the ink-water supply drum to the plate cylinder, said ink fountain including an ink fountain roller driven by a variable speed drive, an adjustable metering blade for the ink fountain roller, a variable speed drive for the water fountain, control means for controlling the ink and water variable speed drives including manually controlled means for individually controlling the ink and water variable speed drives, and means for simultaneously controlling the ink and water variable speed drives in proportion to press speed.

* * * * *